United States Patent [19]

Summa

[11] 4,066,930

[45] Jan. 3, 1978

[54] ENERGIZING CIRCUITS FOR FLUORESCENT LAMPS

[75] Inventor: Frank A. Summa, Staten Island, N.Y.

[73] Assignee: Electrides Corporation, Staten Island, N.Y.

[21] Appl. No.: 669,591

[22] Filed: Mar. 26, 1976

Related U.S. Application Data

[63] Continuation-in-part of Ser. No. 564,369, April 2, 1975, abandoned.

[51] Int. Cl.[2] ..... H05B 41/29; H05B 37/00

[52] U.S. Cl. ..... 315/209 R; 315/DIG. 2; 315/DIG. 5; 315/206; 315/254; 315/276

[58] Field of Search ..... 315/254, 256, 253, 276, 315/DIG. 2, DIG. 5, DIG. 7, 206, 209; 331/113 A

[56] References Cited

U.S. PATENT DOCUMENTS

| | | | |
|---|---|---|---|
| 3,611,021 | 10/1971 | Wallace | 315/DIG. 5 |
| 3,766,467 | 10/1973 | Reising, Jr. | 315/DIG. 2 |
| 3,769,545 | 10/1973 | Crane | 315/DIG. 5 |
| 3,889,153 | 6/1975 | Pierce | 315/DIG. 5 |
| 3,922,582 | 11/1975 | Pitel | 315/DIG. 2 |

*Primary Examiner*—Saxfield Chatmon, Jr.
*Attorney, Agent, or Firm*—Arnold, White & Durkee

[57] ABSTRACT

Apparatus is disclosed which may be utilized as an energizing circuit for the ignition of fluorescent lamps and other gas discharge luminescent devices. The circuit directs energizing signals to gaseous discharge tubes at a voltage sufficient to intitiate ionization of the gases therein. The signals are characterized by having a predetermined frequency in the range from about 20 kilohertz to 10 megahertz. Thereafter, the circuit lowers the voltage and current of the signal delivered to the tubes to a level sufficient to maintain gas ionization. Significant power savings are realized over conventional ballast circuits with the apparatus of the present invention.

5 Claims, 4 Drawing Figures

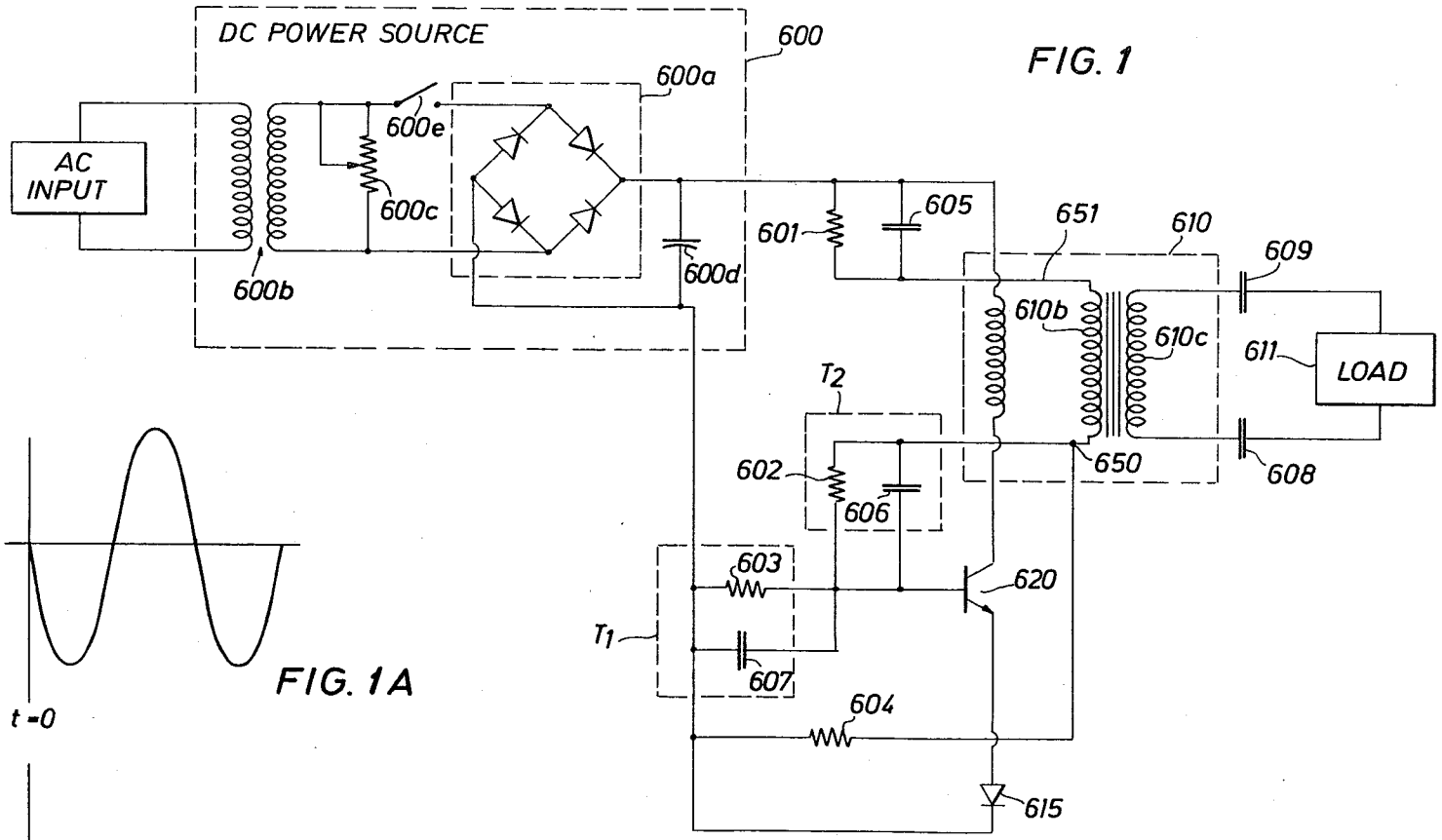
FIG. 1
FIG. 1A
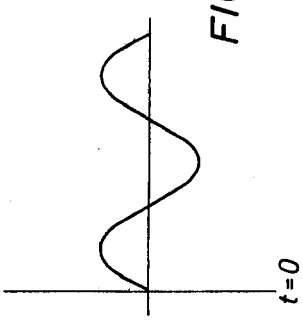
FIG 1B

ENERGIZING CIRCUITS FOR FLUORESCENT LAMPS

CROSS-REFERENCE TO RELATED APPLICATIONS

This application is a continuation-in-part of U.S. patent application Ser. No. 564,369 filed Apr. 2, 1975, and now abandoned.

BACKGROUND OF THE INVENTION

1. Field of the Invention

This invention relates generally to circuits for providing a high frequency energizing signal to electrical energy utilization devices.

2. Description of the Prior Art

The traditional measure of the efficiency of energy utilization in luminescent sources is a parameter called "efficacy", which is the ratio of luminous flux output (lumens) to total power input (watts). For example, the efficacy of present day fluorescent tubes is about 55 to 65 lumens per watt as compared to a figure of about 40 lumens per watt for typical incandescent lamps. Solely from the standpoint of energy utilization efficiency, therefore, it would seen desirable to employ fluorescent lamps for most lighting needs.

However, as relatively efficient as they are when compared with some light sources, present day fluorescent lamps fall far short of the efficiencies theoretically possible. Fluorescent lamps, just as do all gaseous-discharge tubes, require a high voltage to initiate current flow across the lamp terminals. This is due to the fact that there is an infinitely high impedance existing in the tube prior to ignition. Ignition occurs when the gases inside the tube are ionized, thus permitting current to flow between the electrodes at each end of the tube. Once a gaseous-discharge tube has ignited, it exhibits a negative resistance characteristic, and, some sort of current control device is typically utilized to limit the current to the tube. These current limiting devices are referred to as "ballasts."

Typically, a fluorescent lamp ballast includes circuitry adapted to direct a high voltage (which may be as high as 1000 volts) to the gas tube electrodes. This high voltage is necessary in order to force electron emission from those electrodes and thereby initiate ionization of the gases in the tubes. One or both of the electrodes generally comprises a filament which has the capacity of more readily emitting electrons when heated and subjected to such high voltage.

One disadvantage with a present day mercury vapor fluorescent lamp circuit involves the loss of energy in the operation of the ballast and in the heating of the filament electrodes. Another disadvantage is that the lifetime of the lamps is controlled principally by the mechanical integrity of the filaments. Once the filaments break and cease to emit electrons the lamps no longer function, even though the light producing components of the lamp (the gases in the tube and the phosphorus on the tube walls) remain functional.

It is generally acknowledged that the energization of fluorescent tubes with high frequency signals is more efficient than standard ballast circuits. For one reason or another, however, these systems have not been commercially feasible. Apparently, in prior art circuits too much energy is lost in the switching and amplification of transistors and in the operation of the power transformer. Another factor which may have been encountered is the fact that bulb life is greatly reduced and the ends of the tube tend to become blackened due to current distortions in the tube caused, at times, by the introduction into the tube of signals carrying too many harmonics.

SUMMARY OF THE INVENTION

The present invention may be characterized as an energizing circuit for the ignition of fluorescent lamps and other gas discharge luminescent devices. The energizing circuit of the invention comprises a DC voltage source. Coupled to the DC voltage source is an oscillator circuit adapted to generate energizing signals at a fixed frequency, predetermined in optimum value by the size and characteristics of the energy utilization device to be energized, which frequency may be in the range between about 20 KHz to about 10 mHz. The waveform of the energizing signal approximates a sine wave. The oscillator circuit comprises at least one transistor.

An embodiment of the energizing circuit of the present invention includes a ferromagnetic pot core power transformer which is operable over a wide range of frequencies. The ferromagnetic pot core includes first and second primary windings and a secondary winding, with the first primary winding coupled between one terminal of the DC supply and the collector of each transistor. A fluorescent tube is coupled across the secondary winding of this transformer.

An embodiment of the energizing circuit also comprises a first, second, and third parallel R-C circuits, a bias resistor, and an emitter resistor. The first R-C circuit, second primary winding of the ferromagnetic pot core transformer, and the bias resistor are coupled in series between the two terminals of the DC power supply. The second R-C circuit is coupled between one terminal of the bias resistor and the base of each transistor. The third R-C circuit is coupled between the base of each transistor and the second terminal of the DC power supply. An emitter resistor is coupled between the emitter of each transistor and the second terminal of the DC supply.

It is a feature of the present invention that the operating lifetimes of gaseous discharge lamps are greatly extended due to the elimination of the requirement of having filament electrodes, even though the present invention is adaptable to and can be used on tubes containing filament electrodes.

BRIEF DESCRIPTION OF THE DRAWINGS

In the accompanying drawings:

FIG. 1 is an electrical schematic diagram which illustrates one embodiment of the electrical energizing circuit of the present invention.

FIGS. 1A and 1B are graphic representations of the ideal waveform of the signal at points 650 and 651 in FIG. 1 and which have been observed at corresponding points in the embodiment of FIG. 2.

DESCRIPTION OF THE PREFERRED EMBODIMENTS

Figure 2:
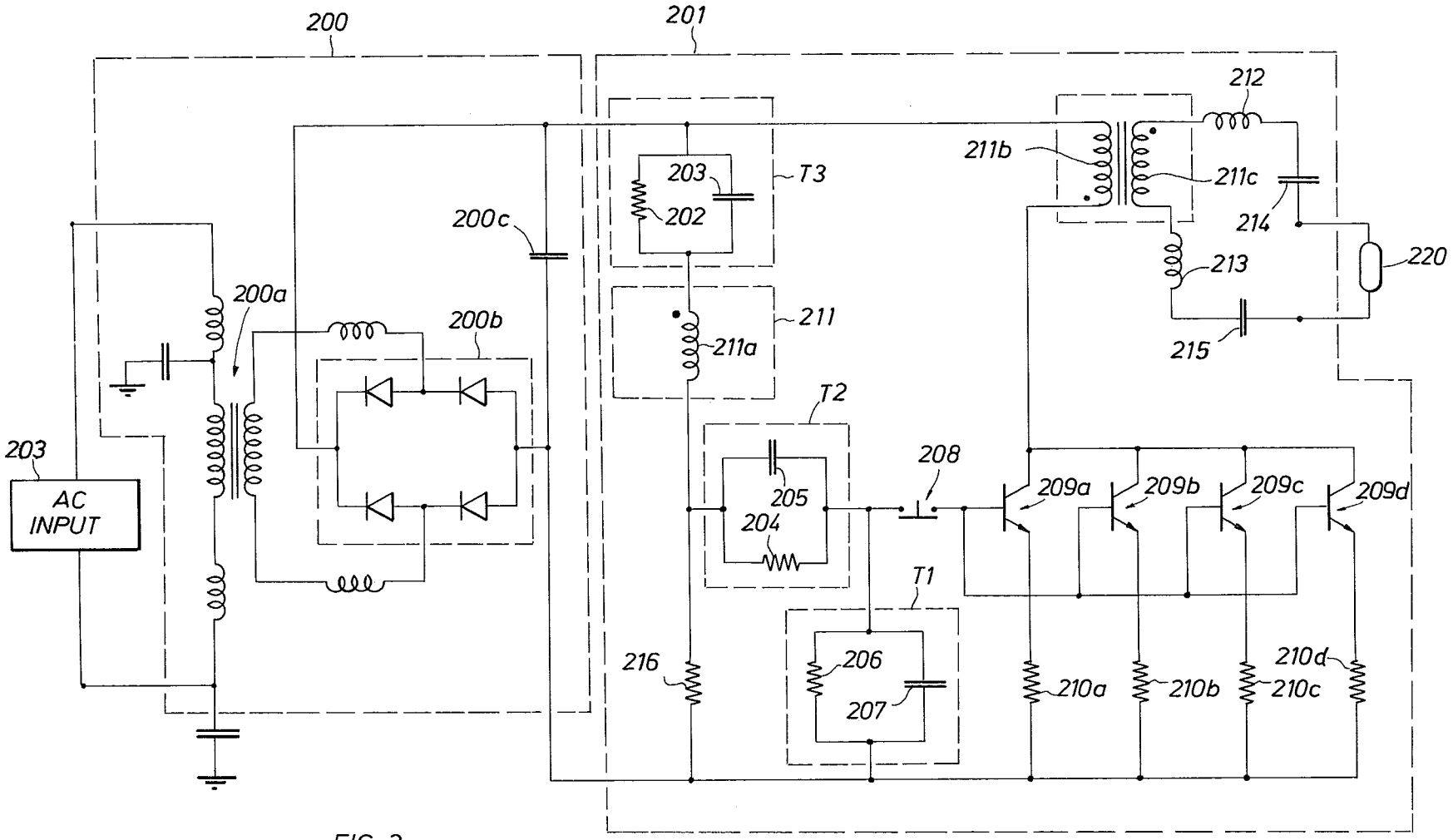
FIG. 2 is an electrical schematic diagram which illustrates a preferred embodiment of the electrical energizing circuit of the present invention.

It will be appreciated that the present invention can take many forms and embodiments. Some embodiments are illustrated and described to give an understanding of the invention. It is not intended that these illustrative embodiments should in any way limit the invention.

With reference now to FIG. 1, there is shown one embodiment of the energizing circuit of the present invention. It comprises DC power source 600, resistors 601 through 604, capacitors 605 through 609, ferromagnetic pot core transformer 610, transistor 620, and diode 615. The first terminal of resistor 601 is coupled to the positive voltage output of DC power source 600, to the first terminal of capacitor 605, and to the end winding of primary 610a of ferromagnetic pot core transformer 610. The second terminal of resistor 601 is coupled to the second terminal of capacitor 605 and to the end winding of primary 610b of ferromagnetic pot care transformer 610. The start winding of primary 610b of ferromagnetic pot core transformer 610 is coupled to the first terminals of resistors 602 and 604 and capacitor 606. The second terminals of resistors 602 and capacitor 606 are coupled to the base of transistor 620 and to the first terminals of resistor 603 and capacitor 607. The emitter of transistor 620 is coupled to the anode of diode 615, and the cathode of diode 615 is coupled to the second terminals of resistors 603 and 604 and capacitor 607 and to the negative output of DC power source 600. The first terminals of capacitors 608 and 609 are coupled to the start winding and the end winding of secondary 610c of ferromagnetic pot core transformer 610. A load 611 may be conveniently connected across the second terminals of capacitors 608 and 609.

It should be apparent to those skilled in the art that there are many methods by which DC power source 600 may be implemented. As shown in FIG. 1 however, it preferably comprises bridge rectifier 600*a* for full wave rectifying of the AC input signal applied to step down transformer 600*b*, resistor 600*c* for adjusting the voltage output of DC power 600, and capacitor 600*d* for filtering the full wave rectified AC input. Potentiometer 600*c* is preferably adjusted so that the voltage at the positive output is approximately 90 volts with respect to ground.

When switch 600*e* of DC power source 600 is engaged, a positive voltage appears at the positive output of DC power source 600. At this time, current will flow through the parallel RC circuit comprised of resistor 601 and capacitor 605 and into the primary 610*b* of ferromagnetic pot core transformer 610. Current will flow out the start winding of primary 610*b* into resistor 604 and into the parallel RC network comprised of resistor 602 and capacitor 606. The current flowing through the RC network of resistor 602 and capacitor 606 continues to flow through the parallel RC network comprised of resistor 603 and capacitor 607 to the negative side of DC power source 600. It should be apparent, therefore, that shortly after DC power is applied to this embodiment of the energizing circuit of the present invention that the base-emitter junction of transistor 620 becomes slightly forward biased.

Because the base-emitter junction of transistor 620 is forward biased, current may flow from the positive terminal DC power source 600 through primary 610*a* of ferromagnetic pot core transformer 610, and through transistor 620 and diode 615 to ground. Because of the mutual inductance between primary 610*a* and 610*b*, the flow of current in primary 610*a* will induce a voltage at the start winding of primary 610*b* which is indicated by reference number 650 in FIG. 1. This voltage will be positive with respect to ground, and will cause increased current flow into the base of transistor 620. Transistor 620 is, therefore, driven further into conduction, which enables more current to be drawn by transistor 620. As transistor 620 goes further into conduction, more current will be passing through primary 610*a* of ferromagnetic pot core transformer 610. This increase in current causes an even higher voltage to be induced at the start winding of primary 610*b* which causes the transistor to go further into conduction. In other words, because of the mutual inductance between primaries 610*a* and 610*b*, a positive feedback occurs between the collector and the base of transistor 620.

After a short period of time, the rate of change of current through primary 610*a* will approach zero. When this occurs, the electromagnetic field developed in ferromagnetic pot core transformer 610 by current flowing in primary 610*a* collapses and a reverse or back electromagnetic force (EMF) is generated across primary 610*a*. Again, because of mutual inductance between primaries 610*a* and 610*b*, a voltage is induced from primary 610*a* to 610*b*. This induced voltage causes the voltage at point 650 to begin to decrease. Consequently, the voltage at the base of transistor 620 decreases, which drives transistor 620 in the direction of cutoff. Furthermore, at this time the voltage at the end winding 651 of primary 610*b* begins to increase. The voltage at the base of transistor 620 becomes negative which cutsoff transistor 620. When the reverse EMF is no longer present, current begins to flow in the initial direction, and the process repeats itself.

The voltages present across primaries 610*a* and 610*b* are reflected to the secondary 610*c* of ferromagnetic pot core transformer 610 and are used to drive the load of 611.

In the preferred embodiment of the invention shown in FIG. 1, the values and/or types of components utilized are shown below in Table 1.

TABLE 1

| FIG. DESIGNATION | COMPONENT | VALUE |
|---|---|---|
| 600c | Potentiometer | 2500 ohm (max) |
| 600d | Filter Capacitor | 1500 mfd, 100v |
| 601,602 | Resistor | 5.6K ohm, 1 watt |
| 603 | Resistor | 12K ohm, 1 watt |
| 604 | Resistor | 7.5K ohm, 5 watts |
| 605 | Capacitor | .02 mfd, 1000v |
| 606,607 | Capacitor | .05 mfd, 1000v |
| 608,609 | Capacitor | .003 mfd, 6000v |
| 620 | Transistor for NPN | 2N 5804 |
| 610 | Ferromagnetic Pot core Transformer | |

Still referring to FIG. 1, the high frequency signal generated by the circuit of the present invention is produced at a voltage level sufficient to excite the gases inside the tube to ionization. This, of course, leads to the release of ultraviolet and visible radiation. Taking a standard fluorescent tube as an example, both argon and mercury are present as gases in the tube. The argon molecules are brought to their ionization potential by the high voltage signal and begin to ionize. It is then the movement of the argon ions coupled with the high frequency oscillations of the field which cause ionization of the more predominant mercury atoms. The mercury ions in turn give off the desired radiation as the electrons in their outer shells move from one energy level to another. A chain reaction of collisions among the mercury atoms as the high frequency signal continues at a reduced voltage has the effect of maintaining the overall ionization state. Apparently, the higher the frequency of the electric field oscillations, the more excited the mercury atoms become, the more collisions there are among the atoms in the tube and the greater the degree of ionization and emitted radiation. It is a unique aspect of the phenomenon produced by the energizing circuit of the present invention that, in the frequency ranges mentioned, as the frequency is increased the current through the lamp may be decreased to a point where exceptionally low levels of power are being consumed in lamp operation. Impressing a high frequency signal into the tube at a sufficient voltage causes ionization of the argon at its fundamental ionization potential. Since argon has a higher ionization potential than mercury, the ionized argon atoms will cause ionization of the mercury atoms.

Still referring to FIG. 1, the illustrated circuitry oscillates at a high frequency to ignite and operate load 611, which, for example, may be a fluorescent tube. By high frequencies it is contemplated to refer to the range of about 20 kHz to about 10 mHz. It should be understood that the concept of the present invention is operable at frequencies lower and even higher than the range limit heretofore given. However, it has been found that at frequencies below about 20 kHz audible noise problems are experienced. Noise can be lessened considerably or even eliminated by a number of different procedures, such as by dipping transformer windings in liquid rubber or other suitable material, or by employing well-known noise suppression techniques to the signal at the output of ferromagnetic pot core transformer 610. Generally speaking, for a given circuit configuration and a given lamp load, there will be a minimum frequency below which the gas molecules will not remain sufficiently agitated to maintain full lamp ignition. While this may be calculated theoretically where the excitation level of a particular gas combination is known, it is more readily predetermined by first choosing a power transformer for the particular lighting load to be anticipated (as will be explained below), and thereafter feeding a range of frequencies through the transformer to a representative load by means of a frequency generator device. Using such a technique the optimum frequency for a given load may also be predetermined. The higher the frequency of the excitation signal, the lower the value of the source current and voltage necessary to sustain continued device performance. Since power utilized at a constant voltage is directly related to the amount of current, power savings may be realized at higher frequency operation. However, for a given lamp load and a given circuit configuration and power transformer, there is also a point above which lighting intensity, as well as overall system efficiency, begins to decrease. For luminescent tubes optimum luminosity will be obtained at various frequencies depending upon the type, size and number of lamps to be energized as well as the nature of the power transformer and the characteristics of the gases in the tube.

According to the principles of the instant invention, ferromagnetic pot core transformer 610, across which the luminescent gas discharge tube or other electrical energy utilization device is connected, is of critical design. The ferromagnetic pot core of transformer 610 is constructed of a high ferromagnetic permeability ferrite material having the following essential characteristics:

a. A very fine grained crystalline structure of iron oxide ($Fe_2O_3$) with other metallic oxides of bivalent metals such as nickel, manganese, zinc, magnesium and the like combined with ceramic bonding materials. This produces a core having ferromagnetic properties (an extremely strong greater than 70% or more molecular alignment in one direction) but which is also a poor conductor of electricity. Therefore, such cores are useful where cores made from ordinary materials which are good conductors would cause too great a loss of electrical energy.

b. the magnetic field in the core is perpendicular to the windings as opposed to straight and parallel fields in other transformers.

c. the ability to be used over a wide range of frequencies. This is due to its ability to realign its molecular structure as polarity reverses on half cycles in accordance with its AC characteristics depending upon the frequency input.

d. the construction of the ferromagnetic pot core is such that when an electric current is passed through the windings, magnetization is along the cube edge axis of the crystalline structure. This vastly improves the operational characteristics of the core.

e. a high resistivity (between about $10^4$ to $10^9$ ohms) and negligible eddy current losses in an alternating magnetic field.

One suitable ferromagnetic pot core is known in the art as SIFERRIT type T26, sold by Siemens A.G.

A second feature of ferromagnetic pot core transformer 610 is the use of the same diameter wire in both the primary and secondary windings. This unique feature is the result of the fact that no power factor lag need be built into the power transformer.

Design of the windings around the polycarbonate bobbin of the ferromagnetic pot core will be governed by a number of critical factors as will be appreciated by those in the art. The magnitude of the voltage output of the energizing circuit will be a function of the size of the pot core, the turns ratio between the primary and secondary windings and, to a lesser extent the diameter of the coil wire. The core windings must have their "start" in the same side and the "end" windings must be on the opposite side for optimum operation otherwise core losses will occur and signal characteristics will worsen. Therefore, for a particular lighting load, these factors will have to be balanced for optimum results. Generally speaking, the largest pot core and the largest wire diameter feasible for a particular output voltage and turns ratio requirement should be used. Of course, the inductance of the core windings must be tuned to the rest of the circuit.

In some applications it will be preferred to employ the core inductance as one element of the pulse generating circuit. In such a case it may be advisable to utilize two primary windings one of which will function as an inductance for a pulse generator circuit, such as a blocking oscillator, and the other operating to determine the amount of current and voltage induced in the secondary.

The insulating material around the primary and secondary windings should be of a high impedence, and also be highly resistive to heat.

As will be appreciated, the air gap between the ferromagnetic pot core halves plays a critical role in the funtioning of the transformer because of its direct relationship to the total inductance of the ferromagnetic pot core. Maximum efficiency is ordinarily achieved with as small a gap as possible. However, the gap may have to be adjusted somewhat in order to "tune" the pot core to the rest of the circuit.

One aspect of the ferromagnetic pot core which contributes greatly to the over-all value of the energizing circuit of the instant invention and differentiates it significantly from the prior art is its adaptability and efficient operation at different frequency levels. Thus, where it is determined that a particular electrical system requires a certain frequency for optimum operation, that frequency may be developed in the pulse generating circuitry without the necessity of employing a different pot core.

This feature also gives the circuit the adaptability of being able to be used in association with dimming circuitry to further conserve energy when high illumination levels are otherwise not required. One manner in which dimming may be accomplished is by lowering the voltage of the signal being directed into the lighting load. This may be done by decreasing the voltage into the circuit or at the base of the switching transistor as will be apparent to those skilled in this art or may also be carried out in some circuit embodiments by decreasing the inductance of the ferromagnetic pot core transformer 610. In all these instances, however, the frequency change has little or no effect on the energy transmission efficiency of the transformer.

The output from the secondary of ferromagnetic pot core transformer 610 is adapted so as to develop a voltage across the terminals of a luminescent gas discharge lamp sufficient to initiate ionization of the gases in the lamp. Current surges which would occur as a result of decreasing impedance once ignition of the gases in the lamp has taken place are prevented by placing a current limiting member such as a capacitor in series with the secondary of the transformer. Of course, care should be taken in assuring that the capacitor utilized has the proper voltage and thermal cycling ratings.

Because the present invention does not require thermionic emission of electrons in order to stimulate ionization of the gases in a luminescent tube, it is a feature of the invention that fluorescent lamps may be ignited without the necessity of the coiled filament electrodes present in fluorescent lamps now on the market. In fact, lamps which have had the filaments broken or destroyed for one reason or another are operable without limitation with the energizing circuit of the invention so long as sufficient gases remain in the tube. As an alternative to the expensive, breakable filaments, electrically conductive circular discs may be employed as electrodes in the lamps. Such circular discs should be highly polished and the interior tube ends should also be highly polished because the reflective quality of highly polished material will result in more ultraviolet wave length being converted into visible light than is presently accomplished. Thus, greater light efficiency is achieved since more ultraviolet wave lengths are reflected to phosphorous which then convert the UV wave lengths to visible light. Indeed, the lamps need not even be provided with electrodes as they have been traditionally known. All that is required is that the high frequency oscillating electric field generated by the circuits of the invention be impressed across the lamp so as to affect the gases inside the tube causing ionization.

The conductors connecting the secondary winding 610*c* of ferromagnetic pot core transformer with the terminals of the lamp should preferably be in shielded cables and/or have a broad, flat or square cross-sectional configuration. This will serve to attenuate any skin effect occurring during transmission of the high frequency signal. Of course, standard conductors will be operable.

The production of ultraviolet radiation and the transformation of such radiation into light takes place more efficiently with the circuit of the present invention because at higher frequencies the atoms are maintained at a higher energy level for longer periods of time. With reference to the fundamental quantum of angular momentum, an atom has a different quantity of energy in each of its angular momentum states. The state which has the least energy is the state in which the electron moves around the fastest and is called the ground state. In this state, the atom does not radiate at all. When the atoms are violently bombarded by collisions at high temperatures; or in an electron vacuum tube; or accelerated by electric fields, the atoms become excited to a higher state. The atom does not radiate at this higher state, but when it returns to a lower energy state is loses energy, and this is the energy radiated. The quantum theory further states that at a particular color or frequency of light, the amount of radiation from an atom will depend upon the total amount of energy losses in a quantum jump from the excited state to the lower energy state. The greater the energy jump, from the higher to the lower state, the bluer the light, or the higher the frequency. Knowing the mass of the electron; the amount of charge on it; and the allowed values of angular momentum, it is possible to predict the energy states to be attained and the amount of energy expended in order to produce a given color of light. It is also possible knowing the above factors, to predict the best gas which should be used in all types of light bulbs and tubes. For example, with a gas such as argon it is possible to generate many atomic lines at relatively low energy input. The radiations given off as the argon atoms descend in energy level from these higher quantum states to the ground state may be utilized in light production. At the same time, the energy absorbed by the gas as it attains each quantum jump to a higher excitation level will determine the resonant frequency level of the gas.

Resonance, therefore, is the point at which the gas system will most efficiently absorb energy. In order to obtain resonance, which is necessary at least at the ignition point, the frequency of the input signal must be matched as closely as possible to the natural frequency of whatever gas is contained in the gas discharge tube. This will also hold radiation losses to an absolute minimum, and reduce skin effection.

Still referring to FIG. 1, the illustrated embodiment of the energizing circuit comprises three parallel R-C circuits two of which are designated T1 and T2. The third R-C circuit comprises resistor 601 and capacitor 605. It has been found through testing that these R-C circuits and the values of the components comprising them are critical to the proper operation of the energizing circuit.

R-C circuit T1 prevents high voltage spikes from appearing between the base and emitter of transistor 620. R-C circuit T2 prevents ringing signals from being present in the base current to transistor 620. The values of resistor 601 and capacitor 605 in the third R-C circuit control the frequency of oscillation of the energizing circuit, and it has been found through testing that the values of components in R-C circuits T1 and T2 do not significantly affect the frequency of oscillation of the energizing circuit.

Referring now to FIG. 2, there is illustrated the preferred embodiment of the energizing circuit of the present invention. It comprises rectifier circuit 200 and oscillator 201. The input of rectifier circuit 200 is suitable for receiving an AC input voltage 203, and the output of rectifier circuit 200 provides a DC voltage to oscillator circuit 201. Oscillator circuit 201 utilizes this DC input voltage to generate an energizing signal to load 202, which energizing signal is essentially a sine wave.

Rectifier circuit 200 comprises a transformer **200*a* which preferably reduces the magnitude of AC input voltage 203. The reduced AC voltage is full wave rectified by full wave rectifier 200*b*, which is preferably a bridge rectifier, as shown. Filter capacitor 200*c* is coupled across the DC output of full wave rectifier 200*b* as a ripple filter to provide a substantially DC voltage at the output of rectifier circuit 200**.

Oscillator circuit 201 comprises parallel R-C circuit T3, ferromagnetic pot core transformer 211, parallel R-C circuit T2, parallel R-C network T1, bias resistor 216, transistors **209*a* -209*d* (which are connected in parallel), emitter resistors 210*a* -210*d*, and circuit breaker 208**, all connected as shown.

Still referring to FIG. 2, the operation of the illustrated preferred embodiment is substantially similar to the operation of the oscillator circuit illustrated in FIG. 1. The oscillator circuit illustrated in FIG. 2 has been found, through testing, to have certain advantages over the oscillator circuit illustrated in FIG. 1, as hereinafter explained.

Ferromagnetic pot core transformer 211 preferably has each of the characteristics above recited with respect ot ferromagnetic pot core transformer 610 (FIG. 1). The serial combinations of: (1) Choke 212 and capacitor 214; and (2) choke 213 and capacitor 215 are coupled in series with the secondary **211*c* of ferromagnetic pot core transformer 211 as shown. One terminal of capacitor 214 comprises one output of oscillator circuit 201, and one terminal of capacitor 215 comprises the second output of oscillator circuit 201. Load 202, which may be one or more fluorescent tubes, it coupled between the two outputs of oscillator circuit 201**.

One advantage of the preferred embodiment of energizing circuit over the FIG. 1 embodiments is the inclusion of circuit breaker 208 in the base circuit of transistors **209*a* -209*d*. If load 202 should become disconnected due to its failure or removal, the base current into transistors 209*a* -209*d* will increase. The circuit breaker trips when the base current reaches a certain level, thus preventing this increased base current from damaging transistors 209*a* -209*d*** and permitting a significant power saving.

Another advantage of the preferred embodiment of the energizing circuit of the present invention is the utilization of transistors **209*a* -209*d*, which are connected in parallel. This parallel configuration allows the energizing circuit to deliver more power to load 202** than if only a single transistor were used.

Another advantage of the preferred embodiment of the present energizing circuit is the inclusion of chokes 212 and 213 and capacitors 214 and 215. The values of the components are chosen to aid in the suppression of radio frequency interference by attenuating any harmonics of the energizing signal which may be present at secondary **211*c* of pot core transformer 211**.

The values and/or types of components which are utilized in the preferred embodiment of the present invention are given below in Table 2.

TABLE 2

| FIG. DESIGNATION | COMPONENT | VALUE and/or TYPE |
|---|---|---|
| 200c | Transformer | Wayne Transformer 125v/68v |
| 200b | Full Wave Bridge | Gen. Inst. KBPC 806 |
| 200c | Capacitor | 1200 mfd, 150v DC |
| 202, 206, 216 | Resistor | 7.5K, 5 Watt |
| 204 | Resistor | 5.6K, 5 Watt |
| 203, 205, 207 | Capacitor | 0.05 mfd, 1500v DC |
| 208 | Circuit Breaker | 150 ma w/140% override |
| 209a–209d | Transistor | RCA 2N6512 |
| 210a–210d | Emitter Resistor | 0.5, 12 Watt |
| 211 | Ferromagnetic Pot Core Transformer | Ferroxcube 4229 C-Al 1600–387 |
| 212, 213 | Choke | Ferroxcube VK 200204B |
| 214, 215 | Capacitor | 0.01 mfd, 3000v DC |

Still referring to FIG. 2, the foregoing remarks with respect to the operation of the parallel R-C circuits of FIG. 1 are equally applicable to the parallel R-C circuits of FIG. 2. It has been found through testing that the values of the resistor and the capacitor comprising each parallel R-C circuit are critical for proper operation of the energizing circuit.

The exact theoretical basis for choosing the values of the resistor and capacitor comprising each parallel circuit is presently unknown. It is believed, however, that the choice of these components is dictated by the type of transistor which is utilized and by the characteristics of the ferromagnetic pot core transformer which is utilized.

Still referring to FIG. 2, it will be noted that breakpoint frequency of parallel R-C networks T1 and T3 is approximately 425 Hertz and that the breakpoint frequency of parallel R-C network T2 is approximately 570 Hertz. Hence, signals having frequencies substantially above these breakpoint frequencies are believed to be attenuated by these R-C networks, thereby providing a "purer" DC signal to the bases of transistors **209*a* -209*d***.

In further testing of the preferred embodiment of the present invention, the values of resistors 202, 204, and 206 were decreased. It was observed that: (1) The decrease in value of resistor 202 changed the frequency of the energizing signal; (2) the decrease in the value of resistor 204 resulted in ringing being present in the current to the base of the transistors **209*a* -209*d*; and (3) the decrease in the value of resistor 206** resulted in voltage spikes being present at the base of each transistor. Hence, although the theoretical basis of operation of the circuitry is not known, this testing tends to establish that there are optimum values of components for a given transistor and a given ferromagnetic pot core transformer.

The values of the capacitors in each of the parallel R-C circuits were also varied from the optimum values set forth in Table 2. When the value of these capacitors was increased, ignition of the fluorescent tube was still achieved, but the energizing circuit drew higher current. As the value of the capacitors was decreased, it was observed that ignition of the fluorescent tube could not be achieved.

It has also been shown through testing that fluorescent tubes which are energized with the energizing circuit of the present invention require significantly less power than fluorescent tubes which are energized by conventional ballasts. The results of these tests show a 30 to 40 percent saving in the power that is required to energize fluorescent tubes with conventional circuitry.

Additional testing has been performed on the preferred embodiment of the present invention to determine the power factor of the AC input voltage when the energizing circuit of the present invention is operating. It was found that this power factor was 0.78, which indicates that the energizing circuit of the present invention presents substantially a resistive load to the AC input voltage.

The foregoing description has set forth and described two embodiments of an energizing circuit for fluorescent tubes that actually works. It is believed that these circuits present a commercially practical means of energizing fluorescent tubes with high frequency energy.

What is claimed is:

1. In a transformer-coupled oscillator circuit for generating a high frequency signal across the secondary of the transformer to energize flourescent tubes, said oscillator circuit including at least one transistor and a DC power source with first and second terminals, the improvement comprising:

a ferromagnetic pot-core transformer having first and second primary windings and a secondary winding, said second primary winding coupled between the first terminal of the DC power source and the collector of each said transistor;

a first parallel R-C circuit having one end thereof coupled to the base of each said transistor and the second end thereof coupled to the second terminal of the DC power source;

a second parallel R-C circuit having one end thereof coupled to the base of each said transistor;

a bias resistor coupled between the second ends of said first and second R-C circuits;

a serial combination of a third parallel R-C circuit and the first primary winding, coupled between the first terminal of the DC power source and the second end of said second R-C circuit; and an emitter resistor coupled between the emitter of each said transistor and the second terminal of the DC power source.

2. The oscillator circuit of claim 1, wherein it comprises four transistors.

3. The oscillator circuit of claim 1, wherein the breakpoint frequency of the first and third parallel R-C circuits is less than 500 Hertz.

4. The oscillator circuit of claim 1, wherein the energizing signal at the secondary of the pot-core transformer is substantially a sine wave.

5. The oscillator circuit of claim 1, wherein it further comprises a circuit breaker which is coupled between said first end of the second parallel R-C circuit and the base of each said transistor.

* * * * *